United States Patent [19]

Agoh

[11] 4,156,961

[45] Jun. 5, 1979

[54] WIRE COLLECTING APPARATUS FOR USE WITH WIRE CUTTING AND INSULATION STRIPPING MACHINE

[75] Inventor: Hitoshi Agoh, Kawanishi, Japan

[73] Assignee: Shin Meiwa Industry Co., Ltd., Nishinomiya, Japan

[21] Appl. No.: 906,833

[22] Filed: May 17, 1978

[51] Int. Cl.[2] ..... B21F 21/00

[52] U.S. Cl. ..... 29/566.3; 29/33 M; 29/566.1; 81/9.51

[58] Field of Search ..... 29/566.1, 564.4, 33 M, 29/566.3; 214/1 P, 16 B; 81/9.51

[56] References Cited

U.S. PATENT DOCUMENTS

| | | | |
|---|---|---|---|
| 2,680,394 | 6/1954 | Andren | 81/9.51 |
| 2,929,284 | 3/1960 | Hagstrand | 81/9.51 |
| 2,998,633 | 9/1961 | Andren | 29/564.4 X |
| 3,032,860 | 5/1962 | Andren | 81/9.51 X |
| 3,552,449 | 1/1971 | Woodward et al. | 81/9.51 X |
| 3,696,948 | 10/1972 | Murdock et al. | 214/16 B |
| 3,741,261 | 6/1973 | Windsor et al. | 29/564.4 X |
| 3,774,283 | 11/1973 | Staiger | 29/564.4 |

*Primary Examiner*—William R. Briggs

*Attorney, Agent, or Firm*—W. G. Fasse; D. F. Gould

[57] ABSTRACT

A long-sized wire collecting apparatus for use with an automatic insulated wire cutting and insulation stripping machine including cutter assemblies for cutting the insulated wires and for cutting the insulations, and a movable clamp device adapted to be reciprocable for effecting the withdrawal of the insulated wires by hauling operation. The apparatus comprises a first wire storing device whereby the wires withdrawn by the movable clamp device are connected into a linear form and two wire lengths cut by a single closing action of the cutter assemblies are temporarily stored and then allowed to drop, a second wire storing device whereby such wire lengths are temporarily stored for a predetermined plurality of times of dropping and then allowed to fall, and a plurality of wire length collecting trays for successively storing such dropped wire lengths intermittently transferring them.

26 Claims, 16 Drawing Figures

WIRE COLLECTING APPARATUS FOR USE WITH WIRE CUTTING AND INSULATION STRIPPING MACHINE

BACKGROUND OF THE INVENTION

1. Field of the Invention

This invention relates to a long-sized wire collecting apparatus which can be advantageously used in combination with an automatic insulated wire cutting and insulation stripping machine, particularly when wires to be cut are long-sized.

2. Description of the Prior Art

The techniques which form the background of the invention are disclosed in, e.g., U.S. Pat. No. 2,680,394 "WIRE CUTTING AND STRIPPING MACHINE" issued to K. H. Andren; U.S. Pat. No. 2,929,284 "MULTIPLE WIRE CUTTER AND STRIPPER" issued to H. W. Hagstrand; and U.S. Pat. No. 2,998,633 "WIRE CUTTING, STRIPPING AND TERMINAL ATTACHING MACHINE" issued to K. H. Andren. The techniques disclosed therein teach an apparatus comprising cutter assemblies, a movable clamp device and a slide bar for slidably supporting said movable clamp device for reciprocating motion. Each cutter assembly comprises a pair of opposed wire cutting blades, pairs of opposed insulation cutting blades disposed on opposite sides of said pair of wire cutting blades, and means for holding said pairs so that they can be opened and closed. Therefore, the withdrawal of the wire by a predetermined amount centrally through the cutter assemblies which are in their opened state is effected by the movable clamp device, followed by the opening and closing operation of the cutter assemblies to effect the cutting of the wire and the cutting of only the insulation on opposite sides of such cutting place, and then the stripping of the cut insulation strips is effected by some movement of the clamp device. Such automatic insulated wire cutting and insulation stripping machine is usually referred to as automatic wire stripper (hereinafter referred to simply as wire stripper).

When said wire stripper is applied where the wire to be cut is long-sized, it is usual practice to mount a suitable cam mechanism on the apparatus for short-sized wires, increase the number of hauling operations using the movable clamp device, withdraw the wire by a predetermined length, and then effect the cutting and stripping. In this connection, the hauling operation on the wire by the movable clamp device is achieved in that the clamp section releases the wire after each stroke. Therefore, the wire being withdrawn considerably downwardly flexes, so that inside the tray for receiving the wire, already cut wire lengths collected therein interfere with the travel of the wire being withdrawn, thus making it difficult for the wire to travel smoothly. As a result, bends are formed on the wire, detracting from the linearity of the wire and disturbing the arrangement of the front ends of the cut wire lengths collected in the wire receiving tray. Such disturbed arrangement of the front ends produces various problems, such as interference with the terminal attaching operation to be performed in the next step.

In order to solve these problems, there has been previously developed a "long-sized wire collecting device for use with automatic insulated wire cutting and insulation stripping machine" disclosed in Japanese Pat. Nos. 20551/72 and 24106/73. In these disclosed apparatuses, however, it is essential for the operator to be present by the side of the apparatus in order to pick up cut and stripped wire lengths, make them into bundles each containing a predetermined number of wire lengths, and suitably package said bundles. Therefore, whenever the operator leaves the apparatus for one reason or another, he has to stop the operation of the apparatus. This decreases the efficiency of operation. Further, since each time a predetermined number of cut wire lengths are prepared, the operator has to remove the same without delay, the operator's mental fatigue has been great.

SUMMARY OF THE INVENTION

This invention is intended to improve the prior art arrangement described above.

In brief, the invention provides a long-sized wire collecting apparatus for use with an automatic insulated wire cutting and insulation stripping machine, comprising a first wire storing device, a second wire storing device and collecting means. The first wire storing device comprises guide means disposed immediately below the path of reciprocating motion of a movable clamp device which withdraws wires, and adapted to correct the withdrawn wires into a linear form, first receptacle means for temporarily storing at least one cut wire length cut by a single closing action of the cutter assemblies and having a first bottom member which can be opened and closed, and first control means for controlling the first bottom member so as to open and close the latter a little after the start of the opening of the cutter assemblies subsequent to the cutting of the wires by the closing action of the cutter assemblies. The second wire storing device comprises second receptacle means disposed immediately below the first wire storing device, having the capacity for storing cut wire lengths obtained by at least a plurality of closing operations of the cutter assemblies, and having a second bottom member which can be opened and closed, and second control means for controlling said second bottom member to open the latter after each time a predetermined number of cutting operations are effected. The wire collecting means is disposed immediately below the second wire storing device and has the capacity for storing a plurality of cut wire lengths once stored at least in the second wire storing device. With the arrangement thus made, the cut wire lengths will no longer be bent, with their opposite ends respectively substantially properly arranged, so that the cut wire lengths can be automatically stored in predetermined numbers and easily taken out from the wire collecting means.

The wire collecting means described above may be replaced by a wire collecting transfer device. Such wire collecting transfer device comprises a plurality of wire collecting means extending horizontally from immediately below the second wire storing device and having the capacity for storing a plurality of cut wire lengths once stored at least in the second wire storing device, transfer means supporting a plurality of equispaced wire collecting means to circulatorily transfer the latter, and means for intermittently driving the transfer means by an amount correlated to the distance to the next wire collecting means each time a plurality of cut wire lengths are received by any one of the wire collecting means.

Further, said wire collecting means may be replaced by additional wire collecting means and a wire collecting transfer device. This additional wire collecting means comprises third receptacle means disposed below the second wire storing device and having the capacity for storing a plurality of cut wire lengths once stored at least in the second wire storing device and also having a third bottom member which can be opened and closed. Further, the wire collecting transfer device extends horizontally from immediately below the position to which the additional wire collecting means is displaced from immediately below the second wire storing device in the direction of withdrawal of wires. Further, control means is provided for moving the additional wire collecting means to its displaced position and for opening and closing the third bottom member each time the additional wire collecting means stores a predetermined number of cut wire lengths. It is then returned to the position immediately below the second wire storing device.

Further, wire receiving tray means may be provided below said wire collecting means for receiving a plurality of cut wire lengths once stored in said wire collecting means.

Accordingly, a principal object of the invention is to provide a long-sized wire collecting apparatus for use with an automatic insulated wire cutting and insulation stripping machine, which is capable of automatically collecting cut wire lengths to form them into groups each having a predetermined number of cut wire lengths.

Another object of the invention is to provide a long-sized wire collecting apparatus capable of collecting cut wire lengths with their opposite ends respectively substantially properly arranged.

A further object of the invention is to provide a long-sized wire collecting apparatus capable of taking out cut wire lengths in groups each having a predetermined number of cut wire lengths.

A further object of the invention is to provide a long-sized wire collecting apparatus which gives the operator a sufficient margin of time to take out cut wire lengths collected therein, thereby minimizing the operator's mental fatigue without decreasing the efficiency of operation.

A further object of the invention is to provide a long-sized wire collecting apparatus capable of smoothly guiding withdrawn wires.

A further object of the invention is to provide a long-sized wire collecting apparatus capable of advantageously correcting withdrawn wires into a linear form.

A further object of the invention is to provide a long-sized wire collecting apparatus capable of achieving its intended objects when a suitable processing mechanism is attached to an automatic cutting and stripping machine, without being hindered thereby.

A further object of the invention is to provide a long-sized wire collecting apparatus capable of continuing its operation without stopping the operation of the automatic cutting and stripping machine associated therewith.

A further object of the invention is to provide a long-sized wire collecting apparatus which can be safely operated.

A further object of the invention is to provide a long-sized wire collecting apparatus which can be easily connected to and disconnected from an automatic cutting and stripping machine, so that it can be easily cleaned, repaired and inspected.

These and other objects and features of the invention will become more apparent from the following detailed description of the present invention when taken in conjunction with the accompanying drawings.

DESCRIPTION OF THE PREFERRED EMBODIMENTS

Referring to FIGS. 1 through 7, the cutting and stripping mechanism of a wire stripper installed in connection with a long-sized wire collecting apparatus according to the invention will first be described.

Figure 1:
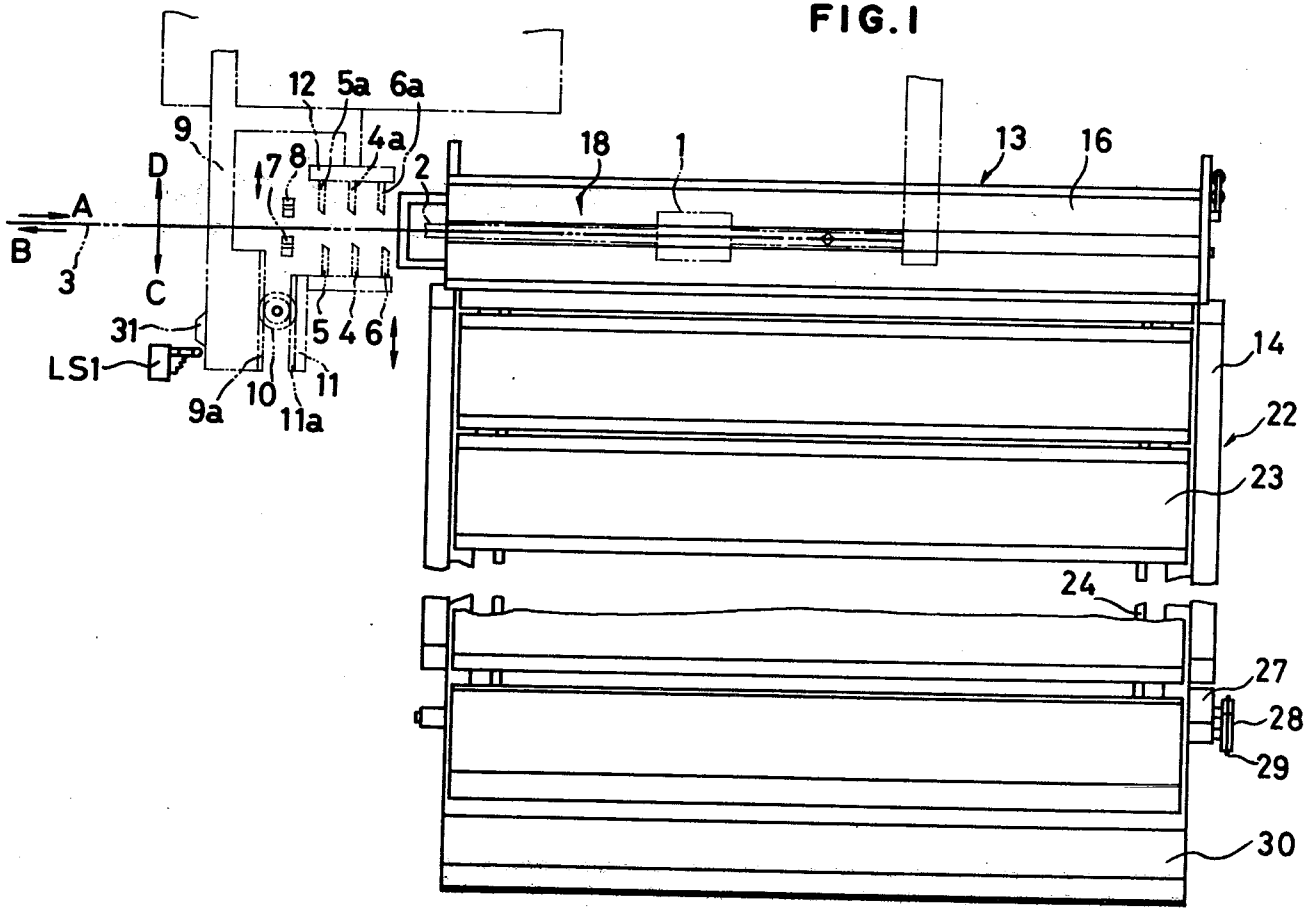
FIG. 1 is a plan view of a first embodiment of the invention.

A movable clamp device 1 is adapted to be reciprocated right and left as viewed in FIG. 1 along a slide bar 2 extending in the wire withdrawing direction and effects the withdrawal of wires 3 from the left while being reciprocated in the direction of arrow A in FIG. 1. The clamp device 1 includes clamp members 1*a* which, when somewhat upwardly retracted, establishes the opened state and which, when downwardly projected, establishes the closed state to clamp the wires 3. Disposed to the left of the movable clamp device 1, as viewed in FIG. 1, i.e., on the wire supply side, is a pair of wire cutters 4 and 4*a*, and disposed on opposite sides of said pair of wire cutters 4 and 4*a* are pairs of insulation cutters 5, 5*a* and 6, 6*a*, said cutters constituting a cutter assemblies. Disposed to the left of said cutter assembly are a pair of fixed clamp members 7 and 8 adapted to establish its closed state for clamping the wires 3 and its opened state for releasing the wires 3.

Figure 4:
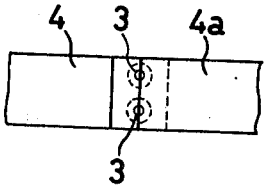
FIG. 4 is a view for explanation of the cutting state of wire cutters.
Figure 5:
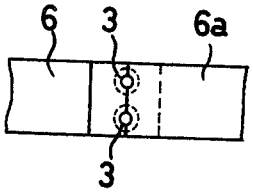
FIG. 5 is a view for explanation of the cutting state of insulation cutters.
Figure 6:
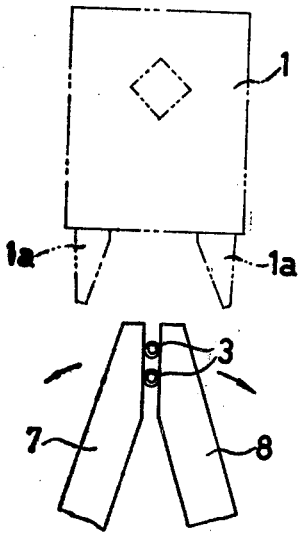
FIG. 6 is a view for explanation of the relation between a movable clamp device and a fixed clamp device.
Figure 7:
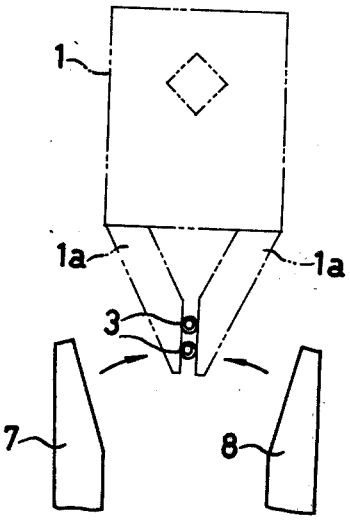
FIG. 7 is a view corresponding to FIG. 6, for explanation of the relation between the movable clamp device and fixed clamp device which are in positions different from those shown in FIG. 6.

An arm 9 is adapted to be reciprocated in the C–D directions shown in FIG. 1 by a cam device (not shown) provided in a drive section. The front end of the arm 9 is formed with a rack portion 9*a* meshing with a pinion 10 which, in turn, meshes with a rack portion 11*a* formed on a front cutter head 11. Therefore, the arm 9 and the front cutter head 11 are reciprocated in reverse directions. The front cutter head 11 holds the front cutter assembly 4, 5, 6, while the rear cutter assembly 4*a*, 5*a*, 6*a* is held on a rear cutter head 12. The rear cutter head 12 is directly interlocked to said cam device (not shown) provided in the drive section so as to be operated integrally with the arm 9, so that the rear cutter head 12 will be reciprocated symmetrically with respect to the front cutter head 11. As a result of such symmetrical reciprocating motion of the cutter heads 11 and 12, the cutters 4, 5, 6 and 4*a*, 5*a*, 6*a* fixed to said two cutter heads are opened and closed in pairs, and in the closing operation, as shown in FIGS. 4 and 5, the cutting of the wires 3 and the cutting of only the insulations on both sides of the cutting places are simultaneously effected. In addition, such opening and closing operation of the cutter assemblies is controlled so that it is effected only once upon completion of a predetermined number, 2 or more, of hauling operations of the clamp device 1. To this end, there are prepared exclusive cams (not shown) arranged so that they can be replaceably mounted according to the desired number of hauling operations.

The operation to be effected by the above arrangement will be described below.

In the first step of the operation, the movable clamp device 1 is in the leftward start position in the direction of arrow B in FIG. 1, with the clamp parts 1*a* opened. Further, the cutters 4, 5, 6 and 4*a*, 5*a*, 6*a* are in their opened state, while the fixed clamp members are in their closed state. This state corresponds to the state shown in FIG. 6.

In the second step of the operation, the cutters 4, 5, 6 and 4*a*, 5*a*, 6*a* maintain the state established in the first step described above. The movable clamp device 1 is still in the leftward start position. Immediately after the clamp members 1*a* have passed between the cutter assemblies and over the fixed clamp members 7 and 8 directed upwardly toward the path of travel of the wires, and at a position a little short of the end of the leftward stroke, the clamp device 1 is once stopped. At this time, the clamp members 1*a* extend downwardly into their closed state to clamp the wires 3.

In the third step of the operation, the clamp device 1 is moved again to the left to some extent while maintaining their state established in the second step described above.

In the fourth step of the operation, the clamp device 1 is shifted to the rightward stroke in the direction of arrow A shown in FIG. 1. At this time, the clamp members 1*a* maintain their closed state, but the fixed clamp members 7 and 8 are opened to permit the clamp members 1*a*, which have clamped the wires, to pass between the fixed clamp members 7 and 8.

In the fifth step of the operation, the movable clamp device 1 moving to the left while clamping the wires 3 and hence withdrawing the wires 3 is once stopped at a position a little short of the end of its rightward stroke. At this time, the fixed clamp members 7 and 8 are closed again to lightly clamp the wires 3.

In the sixth step of the operation, the movable clamp device 1 is moved again to the right to some extent. The clamp device 1 is moved to the right in this way and when it reaches the end of its rightward stroke, the clamp members 1*a* are opened to release the wires 3.

The clamp device 1 after releasing the wires 3 as described above is shifted to the leftward stroke with the clamp members 1*a* maintained in their opened state. This corresponds to the first step described above, and such first through sixth steps are repeated. In accordance with the repetition of the operation, the wires 3 are intermittently withdrawn. In accordance with the number of such repetitions, i.e., the number of hauling operations, the longitudinal dimension of lengths to be cut off the long-sized wires is determined. Therefore, when a predetermined number of hauling operations are performed by repeating the first through sixth steps, the closing of the cutters 4, 5, 6 and 4*a*, 5*a*, 6*a* is effected in said fifth step in the hauling operation at every predetermined number of times of hauling, whereby the cutting of the wires 3 and the cutting of only the insulations on both sides of the cutting places are simultaneously effected.

In the sixth step subsequent to said fifth step which involves said cutting operation, the cutter assemblies are held closed, and, as already described, the movable clamp device 1 is moved again to the right to some extent. Therefore, as a result of the rightward movement of the movable clamp device 1, the insulation strips on the wire lengths 3*a* which are on the right-hand side of the cutting places and which are cut at their left ends continue to be held between the cutters 4, 4*a* and 5, 5*a*, while the cut wire lengths 3*a* alone are pulled by the movable clamp device 1, so that the stripping of insulation is effected. When shifted from the sixth step to the first step, as already described, the clamp device 1 is opened, whereupon the cut wire lengths drop.

In the first step which comes next, the clamp members 1*a* of the clamp device 1 pass over the closed cutter assemblies and the closed fixed clamp members 7 and 8. After this passage, the movable clamp device 1 enters into the second step and is once stopped to permit the clamp members 1*a* to clamp the remaining wires 3 to be withdrawn.

In the third step, the clamp device 1 is moved again to the left to some extent, as already described. In accordance with this leftward movement, the wires 3 are also moved to the left, while the insulation strips on the wires 3 cut at their right ends continue to be held between the cutters 4, 4*a* and 5, 5*a*, so that the stripping of the insulation strips on the right ends of the wires 3 to be subsequently withdrawn is effected.

With a shift from the above described third step to the fourth step, the clamp device 1 is shifted from the leftward stroke to the rightward stroke, as already described. At this time, the cutter heads 11 and 12 are actuated to move away from each other to bring the cutters 4, 5, 6 and 4*a*, 5*a*, 6*a* into their opened state, while the fixed clamp members 7 and 8 are opened.

The operation of the movable clamp device 1 for withdrawing the wires 3 in the fourth step becomes possible in this manner.

The same operation is repeated to successively effect the withdrawing and cutting of the wires 3 and the stripping of insulation. The arrangement and operation described so far are employed in the known wire stripper.

A long-sized wire collecting apparatus according to the invention installed in connection with the above described known wire stripper will now be described.

Figure 2:
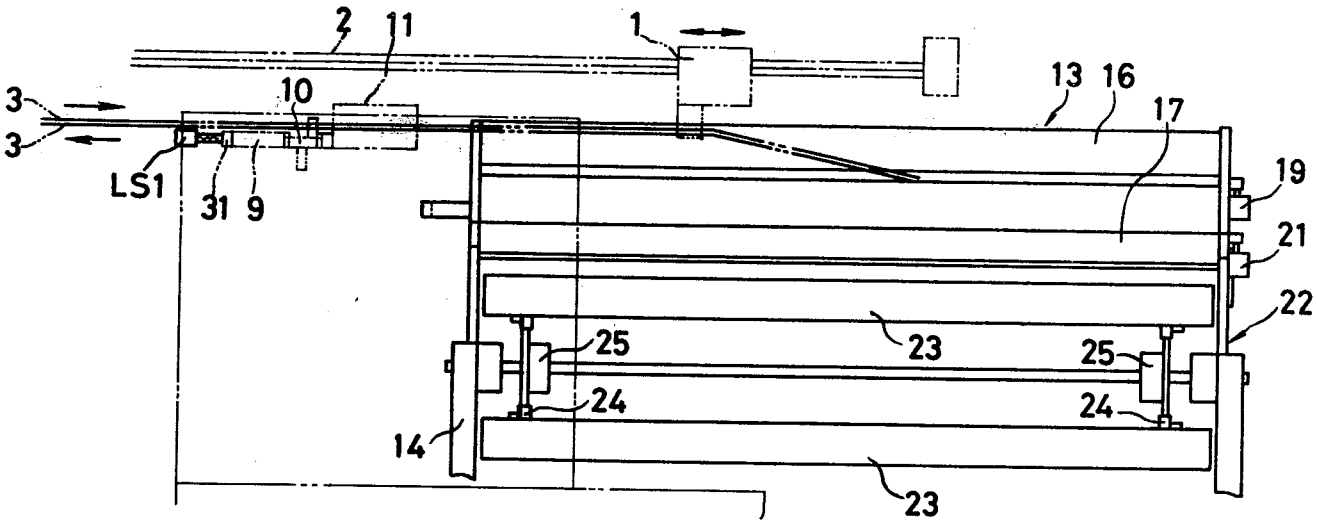
FIG. 2 is a front view of said first embodiment of the invention.
Figure 3:
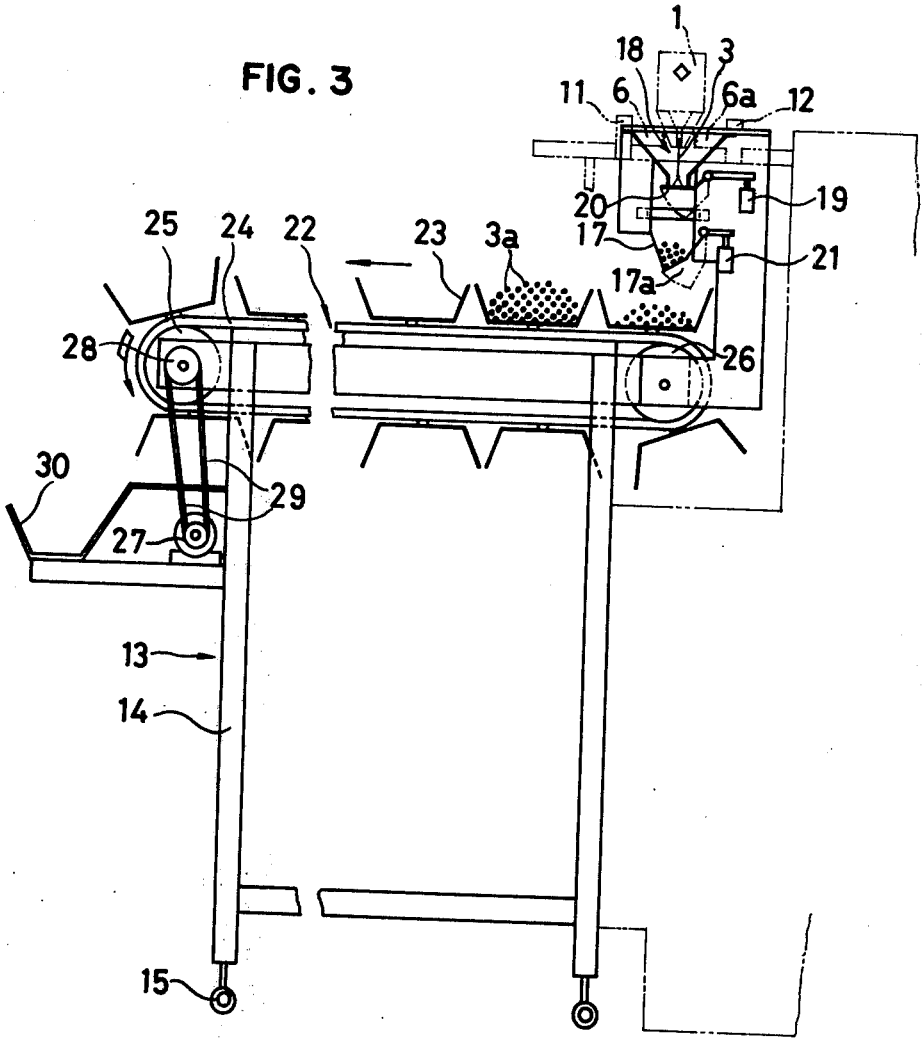
FIG. 3 is a side view of said first embodiment of the invention.

Referring to FIGS. 1 through 3, the long-sized wire collecting apparatus 13 is installed so as to be subsequent to the cutter assemblies. The long-sized wire collecting apparatus 13 includes a carriage 14 having wheels 15 attached to the bottom thereof. Therefore, the long-sized wire collecting apparatus 13 is movable, and it is adapted so that when in use it can be fixed in position with respect to the wire stripper by a suitable fixture (not shown). First and second wire storing devices 16 and 17 are positioned at a higher place on the rear of the carriage 14, i.e., on the wire stripper side and cascade-wise attached to the carriage 14 through a suitable bracket. The first and second wire storing devices each have a V-shaped cross-section, disposed immediately below a path 18 along which the wires 3 are moved by hauling the movable clamp device 1 described above, said devices being adapted so that their bottoms can be selectively opened. The first wire storing device 16 includes two opposed and inclined plates whose bottoms define a long groove of suitable depth. The long groove serves as a guide for correcting the wires 3. The lower opening in the first wire storing device 16 is normally closed by a shutter 20 adapted to be actuated by a first solenoid 19 so that each time cut wire lengths 3*a* drop, it will be opened a little after they have dropped and it will be closed after such cut wire lengths have dropped into the second wire storing device 17. The rear side plate of the second wire storing device 17 constitutes a shutter 17*a* adapted to be actuated by a second solenoid 21. The shutter 17*a* is controlled as by a stepping relay (not shown) so that it will be opened once for every predetermined n1 times of the opening of the shutter 20.

A wire collecting transfer device 22 extends forwardly and horizontally from immediately below the path of movement 18. The wire collecting transfer device 22 includes an endless chain conveyor having a plurality of equispaced wire collecting trays 23. The endless chain conveyor is intermittently driven for circulation to move the wire collecting trays 23 one pitch for every predetermined n2 times of the opening and closing of said shutter 17*a*. More particularly, the transfer device 22 includes an endless chain 24 having wire collecting trays 23 equidistantly fixed thereto. The endless chain 24 is entrained around two sprockets 25 and 26 journaled with respect to the carriage 14 through suitable brackets. A small sprocket 28 is installed coaxially with the sprocket 25. A motor 27 is mounted with respect to the carriage 14 through a suitable bracket. An endless chain extends between the small sprocket 28 and the driving shaft of the motor 27, and the wire collecting trays 23 are moved in the direction of arrow shown in FIG. 3 by driving the motor 27.

Disposed below the terminal end of transfer of the wire collecting transfer device 22 is a wire receiving box 30. Such wire receiving box 30 will be provided as occasion demands.

The lateral surface of the arm 9 of said wire stripper is provided with a projection 31 stuck out the necessary length to control a first limit switch LS1. The first limit switch LS1 is for the purpose of controlling the opening and closing of the shutter 20. Only when the arm 9 is moved in the direction in which to open the cutter assemblies and when engaged by the projection 31, the limit switch LS1 is turned on to energize the first solenoid 19 and only during this engagement, it opens the shutter 20, but when disengaged therefrom, it closes the shutter 20. The stepping relay described above is used to open and close the shutter 17*a* and arranged so that in response to a signal generated when the first limit switch LS1 is disengaged from the projection 31, the relay is stepped and in response to the generation of a predetermined number of such signals, a current flows. In response to this current flow, the second solenoid 21 is energized to open the shutter 17*a*, and concurrently therewith a timer is started. At the end of the interval of time for which the timer is set, the second solenoid 21 is deenergized and hence the shutter 17*a* is closed.

A preset autocounter is provided for counting the number of times of the opening and closing of the shutter 17*a*. It inputs signals, one generated each time the timer is turned off, and it drives the motor 27 by an output signal generated when said input signal is generated the predetermined n2 times. The motor 27 moves the wire collecting trays 23. A second limit switch is provided in connection with the wire collecting trays 23. Therefore, when the wire collecting trays 23 are moved one pitch, the second limit switch is actuated, thereby stopping the drive of the motor 27. Concurrently therewith, a signal generated from the second limit switch is given to the resetting circuit of the above described preset autocounter to bring the count number on the counter back to zero.

Among wire strippers including those which cut wires 3 one by one are others which cut a plurality of wires 3 at each time such as two by two, three by three and so on. If it is desired to collect N wire lengths in each wire collecting tray, letting x be the number of wires to be cut at a time, then $$N = x \cdot n1 \cdot n2.$$

The number x to be cut at a time is predetermined by a wire stripper to be used. Further, the number of times, n1, is determined by the number of input signals for which said stepping relay is set to cause current flow. If, therefore, the number N of cut wire lengths to be collected is determined, then it follows that the number of times, n2, for which the preset autocounter is to be set is automatically determined.

In addition, the shutters 20 and 17*a* have been described as being actuated for opening and closing by solenoids, but air cylinders may be used in place of solenoids.

The operation of the long-sized wire collecting apparatus will now be described in connection with the wire stripper.

Figure 8:
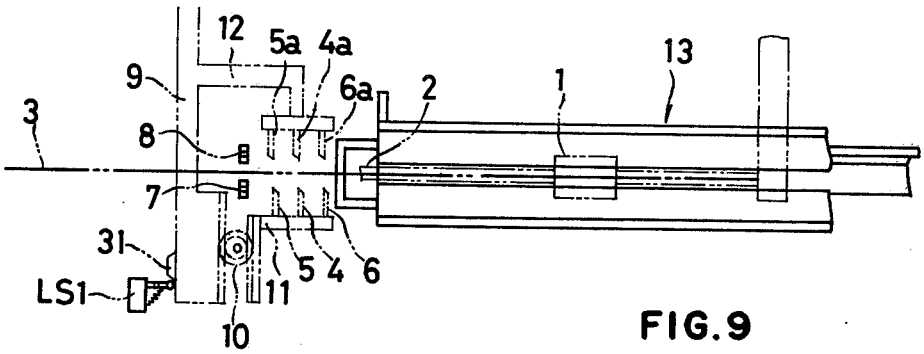
FIGS. 8, 9 and 10 are plan views for explanation of the operation state of the embodiment shown in FIGS. 1 through 3.
Figure 8A:
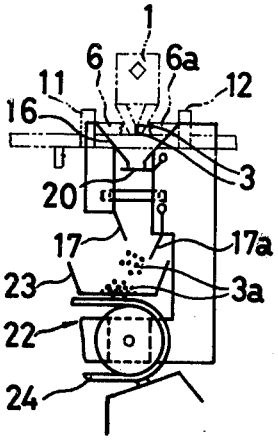

Referring to FIGS. 8 and 8A, the wires 3 are guided from stock rolls (not shown) provided on the left-hand side of the wire stripper, via a guide roller section (not shown). The wires 3 come to the fixed clamp members 7 and 8 and they are clamped by said fixed clamp members 7 and 8. The movable clamp device 1 is reciprocated, as already described, and the wires 3 are hauled by the rightward movement of said movable clamp device 1 to be withdrawn into the path of travel 18. At this time, the shutter 20 of the first wire storing device 16 is in its closed state, with no obstacles remaining in the storing device 16, so that the withdrawn wires 3 are easily and linearly moved along the long groove formed in the V-shaped bottom.

As already described, after the movable clamp device 1 is hauled the predetermined number of times, the movable clamp device 1 is once stopped. At this time, the cutting of the wires 3 and the cutting of only the insulations on both sides of the cutting places are effected.

Figure 9:
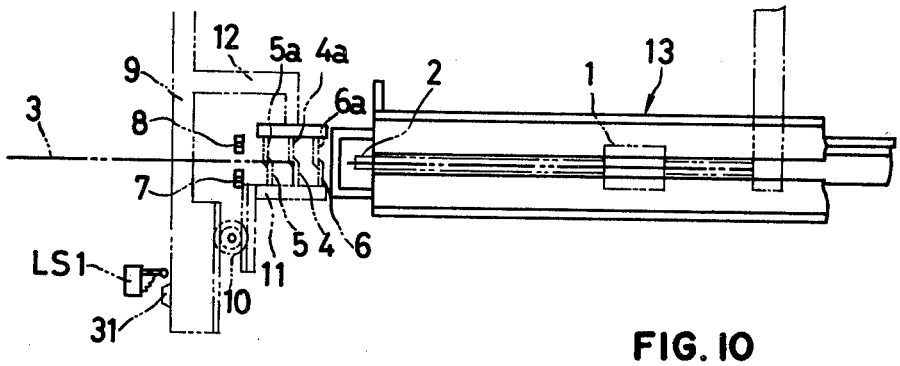
Figure 9A:
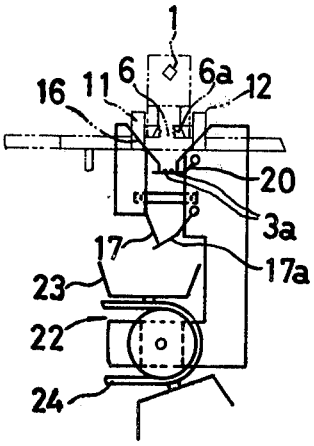
FIGS. 8A, 9A and 10A are side views for explanation of the operating state corresponding to FIGS. 8, 9 and 10, respectively.

Referring to FIGS. 9 and 9A, when the movable clamp device 1 is moved again to the right to some extent, the stripping of insulation at the left-hand ends of the cut wire lengths 3*a* is effected. The clamp members 1*a* of the movable clamp device 1 are opened to release the cut wire lengths 3*a*, which then drop into the first storing device 16. At this time, the cut wire lengths 3*a* still have some amount of bend are corrected into a linear or straight form by the correcting guide in the form of the long groove at the bottom of the first wire storing device 16 and drop onto the shutter 20.

Figure 10:
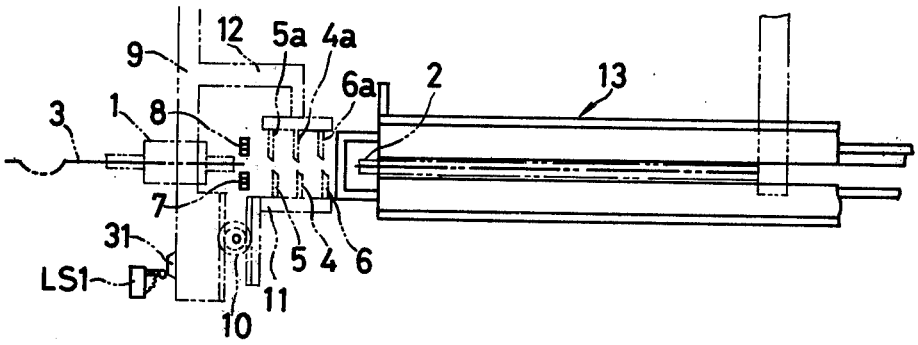
Figure 10A:
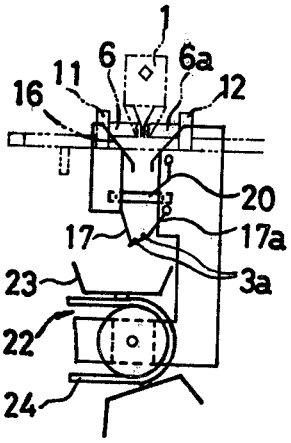

Referring to FIGS. 10 and 10A, in the course of the closing operation of the cutter heads 11 and 12 subsequent to the opening operation of the movable clamp device 1, the projection 31 engages the limit switch LS1 to energize the solenoid 19, so that the shutter 20 is opened, whereby the cut wire lengths 3*a* drop onto the V-shaped bottom of the second wire storing device 17.

The limit switch LS1 deenergizes the first solenoid 19 when it is disengaged from the projection 31 as the latter passes by. In response thereto, the shutter 20 is immediately closed. When the opening and closing operation of the shutter 20 is repeated the predetermined n1 times, the stepping relay is actuated, whereby the solenoid 21 is energized and the shutter 17*a* is opened. Therefore, the x·n1 cut wire lengths stored in the second wire storing device 17 drop in a bunch into the collecting tray 23 and are collected therein.

With the set time for the timer suitably selected, the second solenoid 21 is deenergized before the next opening of the shutter 30 is effected, whereby the shutter 17*a* is closed.

The number of opening and closing operations of the shutter 17*a* is counted by the autocounter. When this count number reaches the preset number of times, n2, an output signal is obtained from the counter and by means of this output signal the motor 27 is driven through a relay. When the endless chain 24 is moved one pitch of the collecting trays 24, the second limit switch is actuated, whereby the motor 27 is stopped and the preset autocounter is reset.

As for the second limit switch, the type adapted to be instantaneously restored is simplest.

What has been described above is considered to be one cycle. The same process is repeated and desired N cut wire lengths 3*a* are collected in each collecting tray 23 and conveyed. These cut wire lengths are picked up at a suitable time by the operator with a sufficient margin of time available to him and are subjected to processes, such as bundling.

A second embodiment of the invention can be attained by somewhat modifying the first embodiment described above. More particularly, the shutter 17*a* of the second wire storing device 17 is normally opened. As a result, cut wire lengths 3*a* drop from the first wire storing device 16 directly into a wire collecting tray 23. When the number of times of such dropping reaches n1·n2, the actuation of the preset autocounter closes the shutter 17*a* of the second wire storing device 17 and actuates the collecting transfer device 22. In response to the completion of movement of the collecting transfer device 22 through one pitch, the second limit switch causes the stopping of the motor 27 and the opening of the shutter 17*a*. With this manner of operation, it is also possible to achieve the same object as in the first embodiment. In the case of this second embodiment, it is not necessary to use a stepping relay and a timer.

Figure 11:
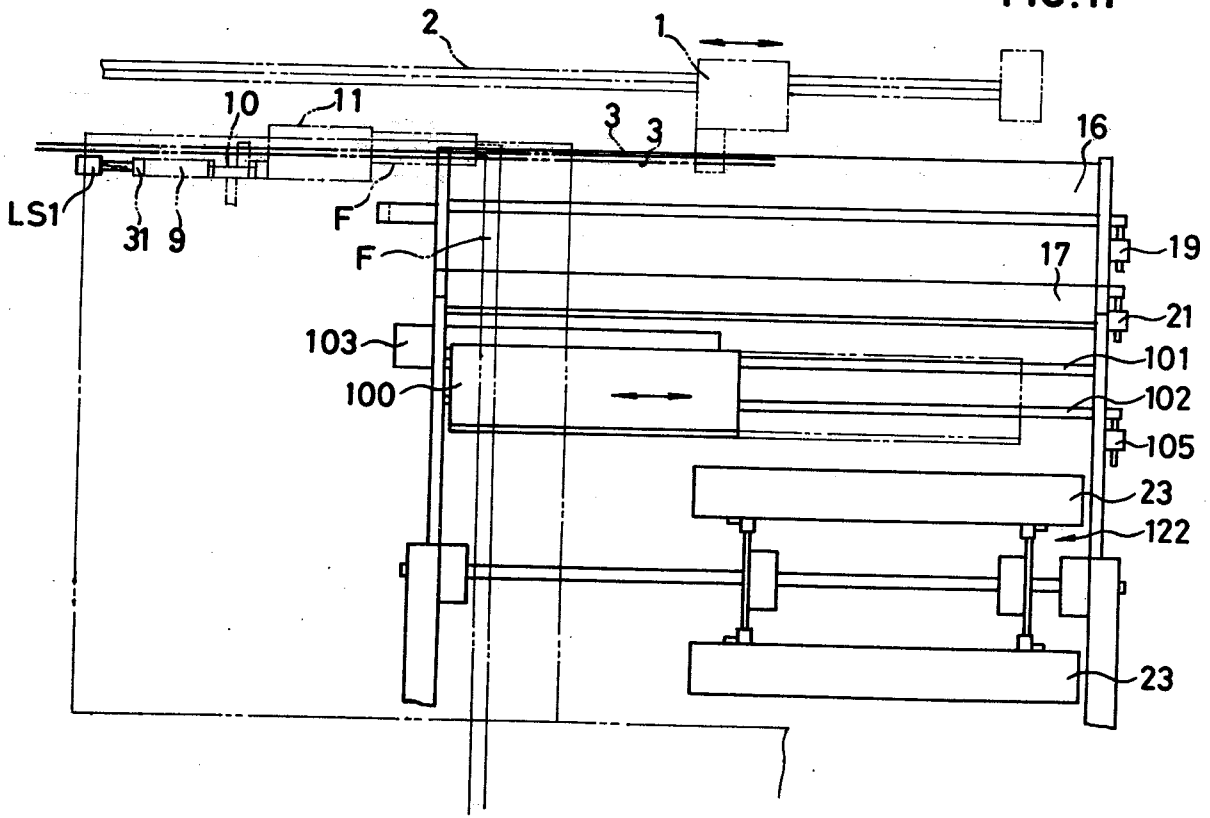
FIG. 11 is a front view showing another embodiment of the invention.
Figure 12:
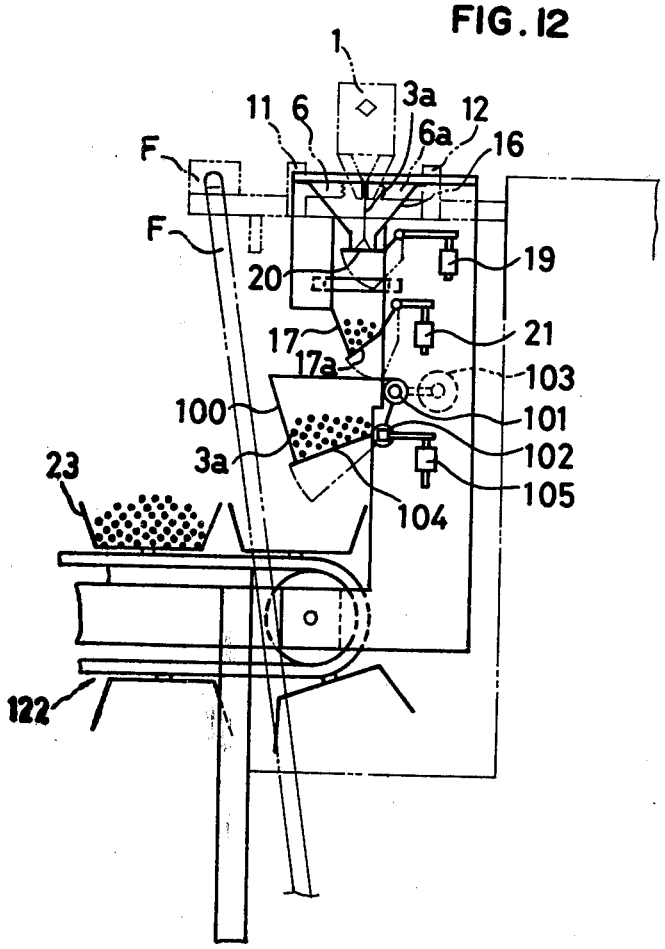
FIG. 12 is a side view of the embodiment shown in FIG. 11.

Referring to FIGS. 11 and 12, a third embodiment of the invention will now be described. The third embodiment can be advantageously applied in the following case.

There may be a case where on the withdrawing side of the cutter assemblies, a special wire processing device F is installed whereby cut wire lengths obtained after the cutting of insulated wires and the stripping of insulation are bent at their ends. In such case, the wire collecting transfer device 22 shown in the first embodiment cannot be installed in such a manner as to extend forwardly from below the first and second wire storing devices 16 and 17, as illustrated in FIG. 1. In the third embodiment, measures have been taken to overcome such difficulty. That is, additional wire collecting tray 100 is provided between the second wire storing device 17 and the wire collecting trays 23 and is so arranged that normally it is positioned immediately below the second wire storing device 17 but that each time the shutter 17*a* is closed, it is moved to the right as viewed in FIG. 11. The additional wire collecting tray 100 is slidably supported on a round shaft 101 and square shaft 102 which extend horizontally at the upper and lower regions thereof, respectively. By the actuation of an air cylinder 103, the additional wire collecting tray 100 is reciprocated, sliding along the two shafts 101 and 102. The bottom of the additional wire collecting tray 100 is arranged so that it can be opened and closed, and the bottom is closed by a shutter 104 supported on the square shaft 102 serving as a rotatory shaft therefor, said shutter 104 being opened and closed by the actuation of a solenoid 105.

Installed immediately below a right-hand side position in FIG. 11 to which the additional wire collecting tray 100 is to be displaced is a wire collecting transfer device 122 somewhat similar to the wire collecting transfer device 22 disclosed in the first embodiment. The wire collecting transfer device 122 includes a plurality of equispaced wire collecting trays 23 and is arranged so that it is moved one pitch each time a predetermined number of cut wire lengths 3*a* stored in the additional wire collecting tray 100 are received by a wire collecting tray 23.

Figure 13:
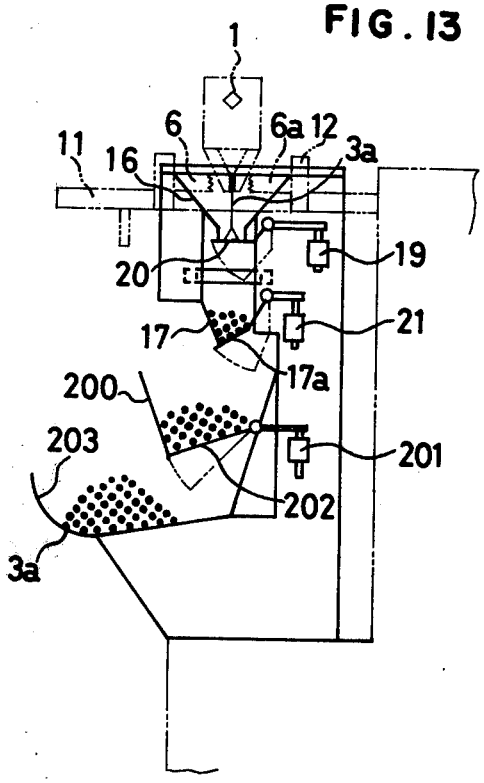
FIG. 13 is a side view showing a further embodiment of the invention.

Referring to FIG. 13, a fourth embodiment of the invention will be described. The fourth embodiment is one in which the collecting transfer device 22 of the first embodiment is simplified. More particularly, disposed immediately below the second wire storing device 17 is a wire collecting tray 200 having the capacity for storing a predetermined number of cut wire lengths 3*a*. The collecting tray 200 is provided at its bottom with a shutter 202 adapted to be opened and closed by a solenoid 201 each time the collecting tray 200 has received a predetermined number of cut wire lengths 3*a*. Disposed below the collecting tray 200 is a wire collecting tray 203 having a suitable storage capacity. With the arrangement thus made, the operator can take out the bundle of a predetermined number of collected cut wire lengths with a sufficient margin of time available to him.

Although the present invention has been described and illustrated in detail, it is to be clealy understood that the same is by way of illustration and example only and is not to be taken by way of limitation, the spirit and scope of the present invention being limited only by the terms of the appended claims.

What is claimed is:

1. A long-sized wire collecting apparatus to be installed in connection with an automatic insulated wire cutting and insulation stripping machine which comprises:

cutter assemblies including a pair of opposed wire cutting blades, pairs of opposed insulation cutting blades disposed on opposite sides of said pair of wire cutting blades, and means for holding said pairs of cutting blades so that they can be opened and closed, a movable clamp device including clamp parts which can be opened and closed, and adapted to be reciprocated longitudinally of wires for withdrawing wires whose insulations are to be stripped and for stripping insulation strips, and a slide bar for slidably supporting said movable clamp device so that the latter can be reciprocated, said apparatus comprising:

a first wire storing device disposed immediately below the path of reciprocating motion of said movable clamp device, including guide means for linearly correcting wires withdrawn by said movable clamp device, first receptacle means for temporarily storing at least a wire length cut by a single closing operation of said cutter assemblies and having a first bottom member which can be opened and closed, and first control means for controlling said first bottom member so as to open and close the latter a little after the start of the opening of said cutter assemblies subsequent to the cutting of wires by the closing of the cutter assemblies, a second wire storing device disposed immediately below said first wire storing device, including second receptacle means having the capacity for storing cut wire lengths obtained by at least a plurality of closing operations of said cutter assemblies, and a second bottom member which can be opened and closed, and second control means for controlling said second bottom member so as to open the latter once for every predetermined number of times of cutting, and wire collecting means disposed immediately below said second wire storing device and having the capacity for storing a plurality of cut wire lengths once stored at least in said second wire storing device.

2. A long-sized wire collecting apparatus as set forth in claim 1, wherein said first receptacle means comprises two inclined plates disposed on opposite sides of the path along which said wires are withdrawn, said plates being opposed to each other and upwardly diverging to form a V-shaped cross-section.

3. A long-sized wire collecting apparatus as set forth in claim 2, wherein said first receptacle means includes a long groove-like bottom having a predetermined depth.

4. A long-sized wire collecting apparatus as set forth in claim 3, wherein said first bottom member which can be opened and closed constitutes shutter means which can be opened and closed and which forms said long groove-like bottom surface.

5. A long-sized wire collecting apparatus as set forth in claim 1, wherein said second control means controls said second bottom member so as to open and close the latter once for every predetermined plurality of opening and closing operations of said first bottom member.

6. A long-sized wire collecting apparatus as set forth in claim 1, wherein said second control means comprises means for closing said second bottom member once for every predetermined plurality of opening and closing operations of said first bottom member, and timer means for opening said second bottom member upon the lapse of a predetermined period of time after said closing of said second bottom member.

7. A long-sized wire collecting apparatus as set forth in claim 1, wherein said wire collecting means comprises: a plurality of wire collecting members extending horizontally from immediately below said second wire storing device, and a wire collecting transfer device which comprises transfer means supporting said plurality of wire collecting members in equispaced relation thereon and circulatorily moving them, and means for controlling said transfer means to intermittently drive them by an amount each time any one of said wire collecting members receives said plurality of cut wire lengths, said amount being correlated to the distance to the next wire collecting member.

8. A long-sized wire collecting apparatus as set forth in claim 7, wherein said transfer means includes conveyor means including an endless chain.

9. A long-sized wire collecting apparatus as set forth in claim 7, wherein said first receptacle means comprises two inclined plates disposed on opposite sides of the path along which said wires are withdrawn, said plates being opposed to each other and upwardly diverging to form a V-shaped cross-section.

10. A long-sized wire collecting apparatus as set forth in claim 9, wherein said first receptacle means includes a long groove-like bottom having a predetermined depth.

11. A long-sized wire collecting apparatus as set forth in claim 10, wherein said first bottom member which can be opened and closed constitutes shutter means which can be opened and closed and which forms said long groove-like bottom surface.

12. A long-sized wire collecting apparatus as set forth in claim 7, wherein said second control means controls said second bottom member so as to open and close the latter once for every predetermined plurality of opening and closing operations of said first bottom member.

13. A long-sized wire collecting apparatus as set forth in claim 7, wherein said second control means comprises means for closing said second bottom member once for every predetermined plurality of opening and closing operations of said first bottom member, and timer means for opening said second bottom member upon the lapse of a predetermined period of time after said closing of said second bottom member.

14. A long-sized wire collecting apparatus as set forth in claim 1, wherein said wire collecting means comprises:

additional wire collecting means including third receptacle means having a third bottom member, and holding means for holding said receptacle means in such a manner as to permit the latter to be reciprocated in the direction of withdrawal of the wires, a wire collecting transfer extending horizontally from immediately below a position to which said additional wire collecting means is to be displaced in said direction of withdrawal of the wires from immediately below said second wire storing device, said wire collecting transfer device comprising a plurality of movable wire collecting means each having the capacity for storing a plurality of cut wire lengths once stored at least in said additional wire collecting means, transfer means supporting said plurality of wire collecting means in equispaced relation thereon and circulatorily moving them, and means for controlling said transfer means to intermittently drive them by an amount each time any one of said wire collecting means receives said plurality of cut wire lengths, said amount being correlated to the distance to the next wire collecting means, and means for controlling said additional wire collecting means so as to move the latter to said displaced position each time said additional wire collecting means receives a predetermined number of cut wire lengths, open and close said third bottom member, and then return said additional wire collecting means to a position immediately below said second wire storing device.

15. A long-sized wire collecting apparatus as set forth in claim 14, wherein said transfer means includes conveyor means including an endless chain.

16. A long-sized wire collecting apparatus as set forth in claim 14, wherein said first receptacle means comprises two inclined plates disposed on opposite sides of the path along which said wires are withdrawn, said plates being opposed to each other and upwardly diverging to form a V-shaped cross-section.

17. A long-sized wire collecting apparatus as set forth in claim 16, wherein said first receptacle means includes a long groove-like bottom having a predetermined depth.

18. A long-sized wire collecting apparatus as set forth in claim 17, wherein said first bottom member which can be opened and closed constitutes shutter means which can be opened and closed and which forms said long groove-like bottom surface.

19. A long-sized wire collecting apparatus as set forth in claim 14, wherein said second control means controls said second bottom member so as to open and close the latter once for every predetermined plurality of opening and closing operations of said first bottom member.

20. A long-sized wire collecting apparatus as set forth in claim 14, wherein said second control means comprises means for closing said second bottom member once for every predetermined plurality of opening and closing operations of said first bottom member, and timer means for opening said second bottom member upon the lapse of a predetermined period of time after said closing of said second bottom member.

21. A long-sized wire collecting apparatus as set forth in claim 1, wherein said wire collecting means comprises:

first wire collecting means disposed immediately below said second wire storing device and having the capacity for storing a plurality of cut wire lengths once stored at least in said second wire storing device, and a second bottom member which can be opened and closed, second wire collecting means disposed immediately below said first wire collecting means and having the capacity for storing a plurality of cut wire lengths once stored in said first wire collecting means.

22. A long-sized wire collecting apparatus as set forth in claim 21, wherein said first receptacle means comprises two inclined plates disposed on opposite sides of the path along which said wires are withdrawn, said plates being opposed to each other and upwardly diverging to form a V-shaped cross-section.

23. A long-sized wire collecting apparatus as set forth in claim 22, wherein said first receptacle means includes a long groove-like bottom having a predetermined depth.

24. A long-sized wire collecting apparatus as set forth in claim 23, wherein said first bottom member which can be opened and closed constitutes shutter means which can be opened and closed and which forms said long groove-like bottom surface.

25. A long-sized wire collecting apparatus as set forth in claim 21, wherein said second control means controls said second bottom member so as to open and close the latter once for every predetermined plurality of opening and closing operations of said first bottom member.

26. A long-sized wire collecting apparatus as set forth in claim 21, wherein said second control means comprises means for closing said second bottom member once for every predetermined plurality of opening and closing operations of said first bottom member, and timer means for opening said second bottom member upon the lapse of a predetermined period of time after said closing of said first bottom member.

* * * * *

UNITED STATES PATENT OFFICE

CERTIFICATE OF CORRECTION

Patent No. 4,156,961 Dated June 5, 1979

Inventor(s) Hitoshi Agoh

It is certified that error appears in the above-identified patent and that said Letters Patent are hereby corrected as shown below:

[57] ABSTRACT; line 9, "connected" should read --corrected--.

Claim 14, line 9, after "transfer", --device-- should be inserted.

Signed and Sealed this

*Eleventh* Day of *September 1979*

[SEAL]

*Attest:*

*Attesting Officer*

LUTRELLE F. PARKER

*Acting Commissioner of Patents and Trademarks*